United States Patent [19]

Argyle et al.

[11] 4,441,547

[45] Apr. 10, 1984

[54] RADIATOR MOUNTING FITTINGS

[75] Inventors: Charles S. Argyle, Willowdale; Richard P. Beldam, Mississauga; Robert J. Hope, Oakville, all of Canada

[73] Assignee: Borg-Warner Corporation, Chicago, Ill.

[21] Appl. No.: 222,414

[22] Filed: Jan. 5, 1981

[51] Int. Cl.[3] ..... F28F 9/00

[52] U.S. Cl. ..... 165/67; 165/153; 180/68.1; 248/232

[58] Field of Search ..... 165/67, 151, 149, 153; 248/352, 232, 632; 180/68 R

[56] References Cited

U.S. PATENT DOCUMENTS

| | | | |
|---|---|---|---|
| 1,008,592 | 11/1911 | Feldkamp | 165/149 |
| 1,250,187 | 12/1917 | Jutrasch | 165/149 |
| 1,374,394 | 4/1921 | Ross | 180/68.4 |
| 1,485,178 | 2/1924 | Frank | 165/67 |
| 1,516,695 | 11/1924 | Atkinson | 165/149 |
| 1,528,461 | 3/1925 | Woolfe | 165/151 |
| 1,575,727 | 3/1926 | Uhlyarik | 165/149 |
| 1,856,924 | 5/1932 | Modine | 165/67 |
| 1,992,130 | 2/1935 | Rose | 165/67 |
| 2,056,318 | 10/1936 | Hammond | 165/67 |
| 2,065,515 | 12/1936 | Cornell, Jr. | 165/149 |
| 2,111,918 | 3/1938 | Moore | 248/232 |
| 2,226,320 | 12/1940 | O'Neail | 165/149 |
| 2,308,119 | 1/1943 | Spieth | 165/149 |
| 2,608,388 | 8/1952 | Miller | 165/149 |
| 2,772,077 | 11/1956 | Polad | 165/67 |
| 3,318,409 | 5/1967 | Kiehnle | 165/67 |
| 3,340,948 | 9/1967 | Deckert | 165/66 R |
| 3,805,889 | 4/1974 | Coolidge | 165/165 |
| 3,833,054 | 9/1974 | Gross et al. | 165/67 |
| 3,897,847 | 8/1975 | Knutson | 180/68.4 |
| 3,960,210 | 6/1976 | Chartet | 165/149 |
| 4,002,201 | 1/1977 | Donaldson | 165/166 |
| 4,011,905 | 3/1977 | Millard | 165/166 |
| 4,058,980 | 11/1977 | Ahlen | 165/166 |
| 4,119,140 | 10/1978 | Cates | 165/67 |
| 4,159,034 | 6/1979 | Bellovary et al. | 165/153 |
| 4,303,052 | 12/1981 | Manfredo et al. | 165/149 |
| 4,330,030 | 5/1982 | Cate | 165/67 |

FOREIGN PATENT DOCUMENTS

| | | | |
|---|---|---|---|
| 595568 | 4/1960 | Canada | 165/153 |
| 462274 | 7/1928 | Fed. Rep. of Germany | 165/153 |
| 2304883 | 8/1974 | Fed. Rep. of Germany | 165/67 |
| 2648407 | 4/1978 | Fed. Rep. of Germany | 180/68 R |
| 2928523 | 7/1979 | Fed. Rep. of Germany | 165/67 |
| 507163 | 9/1920 | France | 257/131 |
| 216629 | 9/1941 | Switzerland | 165/149 |
| 483605 | 12/1970 | Switzerland | 248/232 |
| 13163 | of 1911 | United Kingdom | 165/153 |

*Primary Examiner*—William R. Cline
*Assistant Examiner*—John M. Kramer
*Attorney, Agent, or Firm*—James A. Geppert

[57] ABSTRACT

Fittings for the mounting of a radiator to the metalwork of an automotive vehicle, or for mounting attachments such as fan shrouds or cooling fans, are suitably positioned within the core of the radiator and attached in position during the bonding cycle for the radiator assembly or adhesively joined to the radiator core after the bonding cycle.

11 Claims, 12 Drawing Figures

RADIATOR MOUNTING FITTINGS

BACKGROUND OF THE INVENTION

Heat exchangers, such as water-to-air radiators or oil-to-air coolers, are currently attached to the vehicle metalwork through mounting brackets that are brazed, soldered or bolted to the heat exchanger. Similarly, auxiliary equipment, such as shrouds, fans or additional heat exchangers, are attached to a heat exchanger through supplementary brackets, angles, channels or other metal or plastic sub-assemblies. These fixtures increase the cost, weight and complexity of the structure and the difficulties in positioning the mounting means on the heat exchanger. The present invention obviates these problems by providing a direct attachment of the heat exchanger to the vehicle or component.

SUMMARY OF THE INVENTION

The present invention comprehends the provision of a novel mounting means for a vehicle heat exchanger or radiator without requiring supplementary members. The mounting means comprises metal or plastic inserts which are located in spaces in the core of the heat exchanger and are permanently secured therein. Each insert is drilled and/or tapped to accept screws or bolts for attachment to the vehicle or attaching shrouds or fans to the radiator unit.

The present invention also comprehends the provision of a novel mounting means for a heat exchanger wherein the mounting means comprises a metal tube, rod, block or other shape of a material compatible with the metal forming the heat exchanger so that it can be brazed thereto. The tube, block, or other shape is inserted into a suitable space in the heat exchanger core during assembly of the heat exchanger and becomes an integral part of the core after the brazing cycle for the assembled heat exchanger.

The present invention further comprehends the provision of a novel mounting means for a heat exchanger in the form of a tube, rod, block, etc. formed of a suitable plastic material. After the heat exchanger is joined together, the plastic mounting means is fastened in a space in the core by a suitable adhesive.

Further objects are to provide a construction of maximum simplicity, efficiency, economy and ease of assembly, and such further objects, advantages and capabilities as will later more fully appear and are inherently possessed thereby.

DESCRIPTION OF THE PREFERRED EMBODIMENTS

Figures 1, 2, 3, 4, 5, 6:
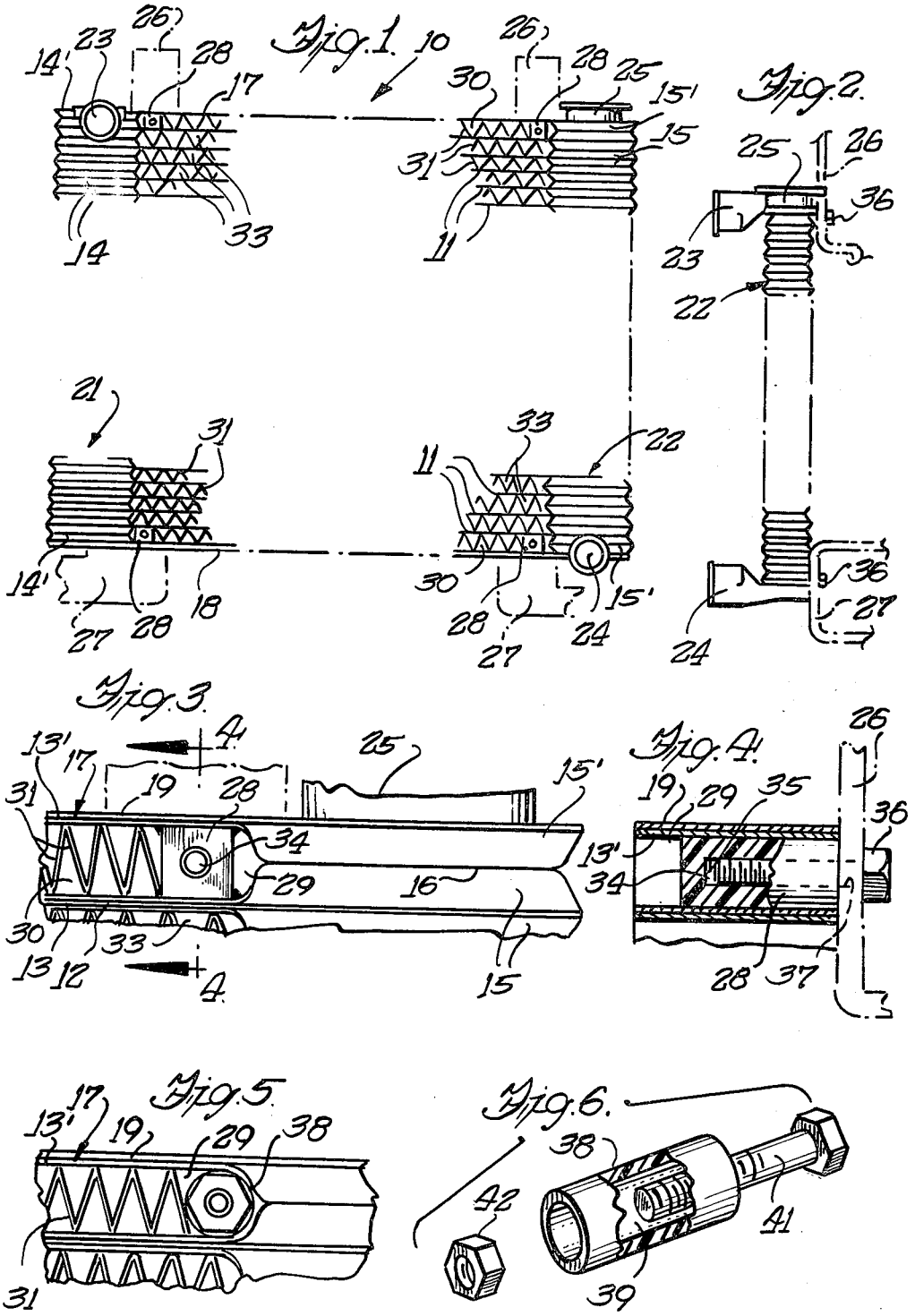
FIG. 1 is a partial rear elevational view of a plate-like vehicle radiator employing a block-type mounting means of the present invention.
FIG. 2 is an end elevational view of the radiator taken from the right-hand side of FIG. 1.
FIG. 3 is an enlrged partial rear elevational view of the upper right-hand corner of FIG. 1.
FIG. 4 is a vertical cross sectional view taken on the line 4—4 of FIG. 3.
FIG. 5 is an enlarged partial rear elevational view similar to FIG. 3 but using a tubular mounting means.
FIG. 6 is an enlarged exploded perspective view of the tubular mounting means of FIG. 5.

Referring more particularly to the disclosure in the drawing wherein are shown illustrative embodiments of the present invention, FIG. 1 discloses a plate-like heat exchanger or radiator 10 for use in the cooling system of an automotive vehicle wherein the radiator comprises a plurality of heat transfer members 11 formed of pairs of dished plates joined at their peripheries 12; each plate having a central elongated core portion or fluid conduit 13 with enlarged end portions or bubbles 14 and 15. The bubbles 14 and 15 of a member 11 extend beyond the core to abut the bubbles of adjacent members 16. The top element 17 and the bottom element 18 are each formed of a single plate having bubbles 14' and 15' at the opposite ends of a core portion 13', and a generally flat plate 19. The aligned bubbles 14, 14' form an elongated inlet header or chamber 21, and the aligned bubbles 15, 15' form an elongated outlet header or chamber 22. An inlet 23 communicates with the inlet header 21 adjacent the top plate 19, and an outlet 24 communicates with the outlet header 22 at the bottom element 18. Also, a filler neck 25 extends through the top plate 19 in alignment with the outlet header 22 and receives a suitable vent cap (not shown).

Upper mounting brackets 26 and lower mounting brackets 27 are secured to the vehicle frame (not shown) and are aligned with the mounting means for the radiator 10. In conventional vehicle radiators, mounting brackets in the form of L-shaped brackets, angles, channels or similar members are suitably secured to the radiator by brazing, soldering or bolted connections. The brackets on the radiator are bolted to the mounting brackets 26 and 27 on the vehicle. As shown in FIGS. 1 through 4, the brackets on the radiator are replaced by several square or rectangular blocks 28 which are inserted into spaces 29 between the core portions 13 of adjacent members 11; heat transfer fins 31 being located in the remainder of the space 30 and extend between the blocks. The spaces 33 between the core portions 13 of all of the other members in the core also have heat transfer fins 31 therein.

Each block 28 has a central opening 34 drilled therein and tapped to provide internal threads 35. These threads engage threaded screws or bolts 36 which are inserted through openings 37 in the brackets 26 or 27 and extend into threaded engagement with the block 28. Each block is of a length to extend substantially through the core as seen in FIG. 4 and is of a dimension similar to the fin height. In the alternative, the block could be through drilled to accept a through bolt for mounting.

The blocks 28 may be formed of metal or plastic. If metal, the block is formed of a material compatible for brazing or soldering to the metal forming the radiator.

Thus, the block is positioned in a space 29 in the radiator core when the radiator is assembled for the brazing cycle, and the block is brazed in the cycle to become an integral part of the core. This arrangement is especially suited for a brazed aluminum radiator, although the inserts could be used on any fin-tube core heat exchanger unit and be attached with a suitable joining method for the material being used; such as brazing or soldering for a copper-brass radiator. If the block is plastic, it would be fastened into the core after the bonding cycle by means of a suitable adhesive. For example, the blocks can be formed of silicone type materials attached by adhesives. The plastic block is also bored out or drilled and tapped to receive the mounting bolts.

FIGS. 5 and 6 disclose an alternate mounting member in the form of a rod or tube 38 which is positioned in the space 29 in the radiator core and extends substantially through the core. If the member is a rod, it is drilled and tapped or through bored. Obviously, the tube has a central passage 39 (FIG. 6) to receive a through bolt 41 cooperating with a nut 42. Also, the tube could be tapped to receive a mounting screw or bolt.

FIGS. 7 through 12 disclose the utilization of the mounting means in a cross flow fin-tube vehicle radiator 45, with like parts receiving the same reference numeral with a script a. The radiator 45 includes an inlet tube 46 having a coolant inlet passage 47, an outlet tank 48 having an outlet passage 49 and a heat transfer core 51. The core consists of a plurality of parallel flat tubes or fluid conduits 52 communicating with the inlet and outlet tanks 46,48, and the spaces 53 between the tubes receive folded or corrugated heat transfer fins 54. Also, the outlet tank 48 has a filler neck 55 at the upper end for a pressure relief cap (not shown).

Figure 7:
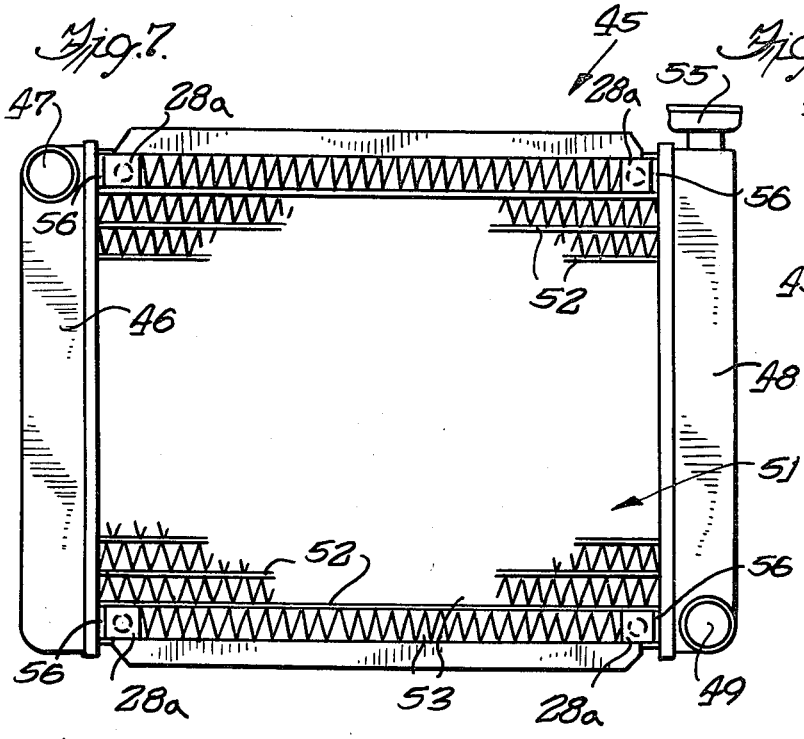
FIG. 7 is a rear elevational view of a fin-tube core radiator utilizing the mounting means of the present invention.
Figure 8:
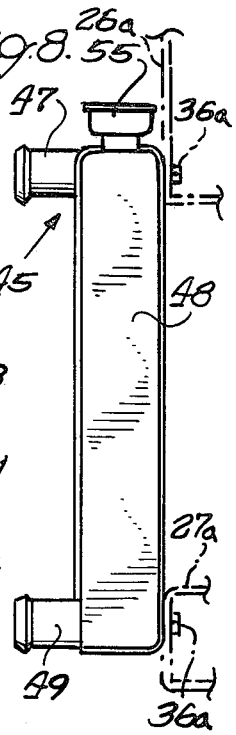
FIG. 8 is an end elevational view of the radiator taken from the right-hand end of FIG. 7.
Figure 9:
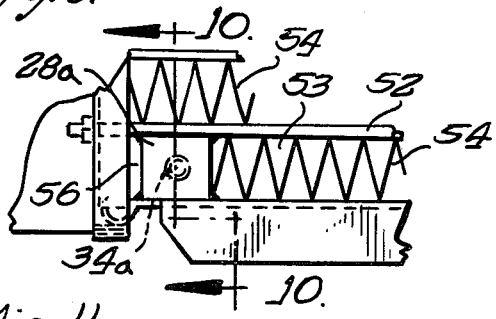
FIG. 9 is an enlarged partial rear elevational view of one type of mounting means in the radiator core.
Figure 10:
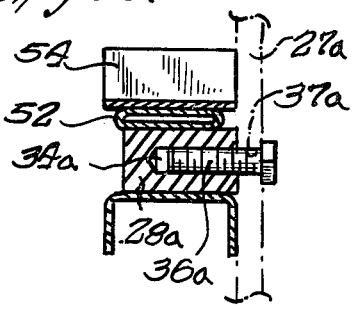
FIG. 10 is a cross sectional view taken on the irregular line 10—10 of FIG. 9.

Within a space 56 (FIG. 9) between two tubes or fluid conduits 52 and adjacent tank, a rectangular mounting block 28*a* is positioned, such as shown at the lower left-hand corner of FIG. 7. The block has a central opening 34*a* drilled therein and tapped to provide internal threads receiving a mounting bolt 36*a* inserted through an opening 37*a* in a mounting bracket 26*a* or 27*a*. The block is of a length generally corresponding to the width of a flat tube 52. This block 28*a* would be joined to the core in the same manner as previously described.

Figure 11:
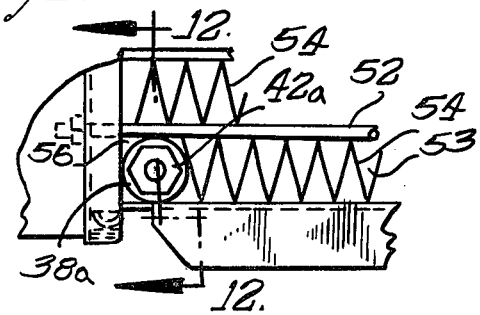
FIG. 11 is an enlarged partial rear elevational view showing an alternate form of mounting means.
Figure 12:
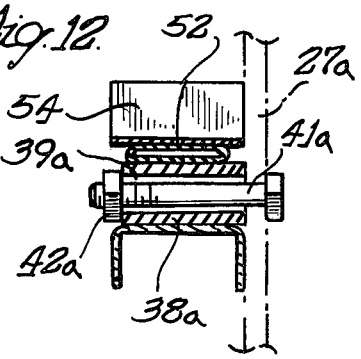
FIG. 12 is a cross sectional view taken on the irregular line 12—12 of FIG. 11.

FIGS. 11 and 12 disclose a tube or rod 38*a* located in the space 56 between the fluid conduits and between the fin 54 and an adjacent tank 46 or 48. The rod may be drilled and tapped or bored completely through the rod as shown to provide a passage 39*a* to receive a through bolt 41*a* cooperating with a nut 42*a*. Obviously, a tube already has a central passage to be used with a bolt and nut or the passage could be internally threaded to threadingly receive a mounting screw or bolt therein. Although shown for a cross-flow flat tube and fin radiator, the mounting means would be equally applicable to a downflow radiator of the flat tube and fin type.

Although shown for attachment to a mounting bracket on the vehicle body or frame, the same mounting blocks, rods or tubes can be used for connection to the radiator core of ancillary equipment, such as shrouds, fans or additional heat exchangers, such as oil coolers or condensers.

We claim:

1. In a heat exchanger having inlet and outlet headers forming inlet and outlet chambers or tanks connected by a heat transfer core including a plurality of generally parallel fluid conduits spaced apart and having generally corrugated heat transfer fins therebetween, some of said fins terminating short of and providing a mounting space adjacent to said headers between adjacent conduits on the air side, and mounting means received in and extending through said mounting space, said mounting means being secured to said fluid conduits, said mounting means consisting of a solid member of a length to extend substantially through the core and of a height substantially equal to the spacing between adjacent conduits, each member having an opening extending axially at least partially therethrough to receive mounting screws or bolts extending from mounting brackets on an article to which the heat exchanger is secured.

2. A heat exchanger as set forth in claim 1, in which said mounting means comprises a square or rectangular block extending substantially through the core and having a central opening extending at least partially therethrough.

3. A heat exchanger as set forth in claim 2, wherein said block is formed of a metal which is joined to the fluid conduits during the bonding cycle for the heat exchanger.

4. A heat exchanger as set forth in claim 2, wherein said block is formed of a suitable plastic material that is adhesively joined to the fluid conduits after the bonding cycle for the heat exchanger.

5. A heat exchanger as set forth in claim 2, in which said block has an opening therein that is drilled and tapped to receive a mounting bolt in threaded engagement.

6. A heat exchanger as set forth in claim 2, in which said block has an opening through-bored therein to receive a through bolt.

7. A heat exchanger as set forth in claim 1, wherein said mounting means comprises a rod or tube of a diameter substantially equal to the spacing between adjacent conduits and having a central opening extending at least partially therethrough.

8. A heat exchanger as set forth in claim 7, in which said rods has an opening drilled and tapped therein to receive a mounting screw or bolt.

9. A heat exchanger as set forth in claim 7, in which said rod or tube has a through-hole to receive a through-bolt therein.

10. A heat exchanger as set forth in claim 7, in which said rod or tube is formed of a metal that is brazed integral with said fluid conduits in the brazine cycle for the heat exchanger.

11. A heat exchanger as set forth in claim 7, in which said rod or tube is formed of a plastic that is adhesively joined in the fluid conduits after the bonding cycle for the heat exchanger.

* * * * *

UNITED STATES PATENT AND TRADEMARK OFFICE

CERTIFICATE OF CORRECTION

PATENT NO. : 4,441,547

DATED : April 10, 1984

INVENTOR(S) : Charles Stuart Argyle, Richard Paul Beldam and Robert John Hope

It is certified that error appears in the above—identified patent and that said Letters Patent is hereby corrected as shown below:

Column 4, line 48, cancel "rods" and insert -- rod --.

Column 4, line 55, change "brazine" to -- brazing --.

Signed and Sealed this

Fourth Day of September 1984

[SEAL]

*Attest:*

GERALD J. MOSSINGHOFF

*Attesting Officer*

*Commissioner of Patents and Trademarks*